United States Patent [19]

Cordell

[11] 4,216,636

[45] Aug. 12, 1980

[54] TOWER

[76] Inventor: Jack R. Cordell, 648 Seneca Trail, Shreveport, La. 71107

[21] Appl. No.: 859,371

[22] Filed: Dec. 12, 1977

[51] Int. Cl.[2] ..... F04N 12/00

[52] U.S. Cl. ..... 52/637; 52/726

[58] Field of Search ..... 52/146, 148, 653, 654, 52/655, 721, 726, 637, 638, 40, 649; 343/800; 403/337

[56] References Cited

U.S. PATENT DOCUMENTS

| | | | |
|---|---|---|---|
| 1,658,535 | 2/1928 | Neilson, Sr. | 52/638 X |
| 1,693,107 | 11/1928 | Campbell | 52/40 X |
| 2,308,565 | 1/1943 | Mitchell | 403/337 X |
| 2,761,531 | 9/1956 | Anderson | 52/654 X |
| 3,119,471 | 1/1964 | Turner | 52/654 X |
| 3,360,288 | 12/1967 | Holscher | 52/654 X |
| 3,371,458 | 3/1968 | Sturgill | 52/726 X |

*Primary Examiner*—Price C. Faw, Jr.
*Assistant Examiner*—Carl D. Friedman

[57] ABSTRACT

A tower characterized by a rigid, self-supporting structure which includes a set of vertically oriented outside legs arranged in a generally triangular configuration and a set of vertically oriented inside legs also arranged in a generally triangular configuration and positioned adjacent the outside legs, which outside legs and inside legs are fitted with a plurality of generally horizontally disposed braces and are supported in spaced relationship by a plurality of collars also oriented in generally horizontal and spaced relationship along the length of the tower. In a preferred embodiment the outside legs and inside legs are fastened to the collars by means of flanges.

6 Claims, 7 Drawing Figures

FIG. 1
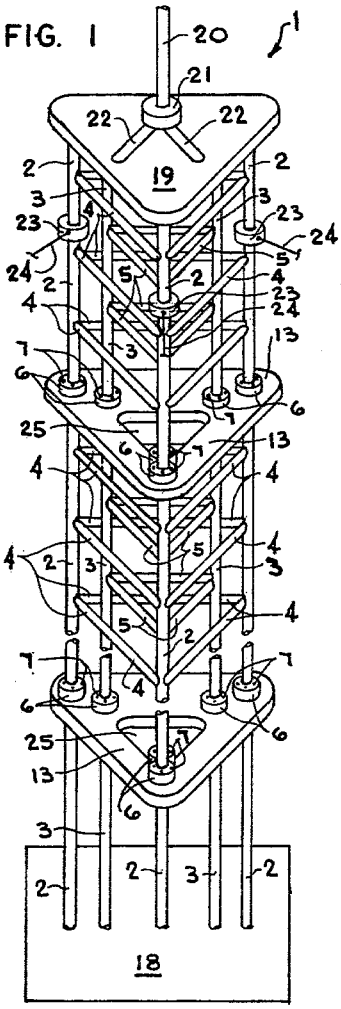
FIG. 2
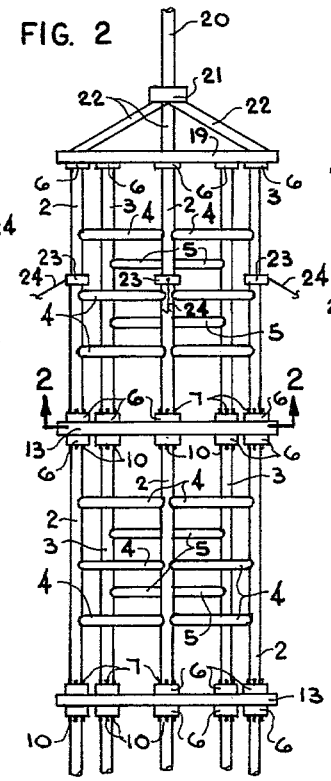
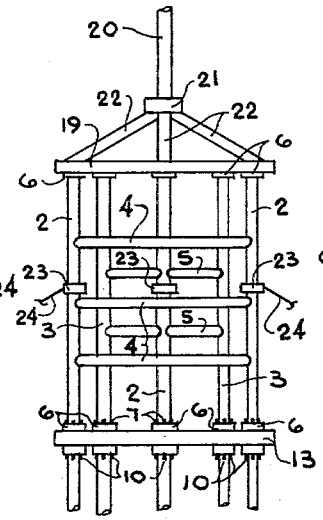
FIG. 3
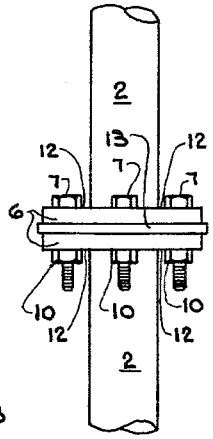
FIG. 7
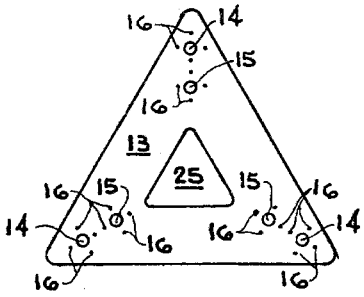
FIG. 5
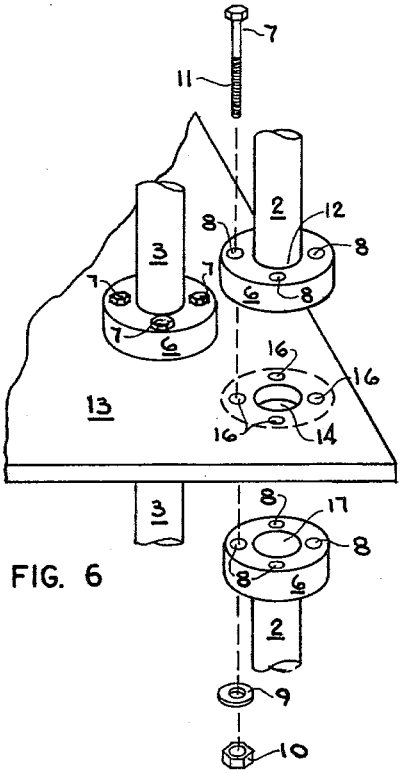
FIG. 6
FIG. 4
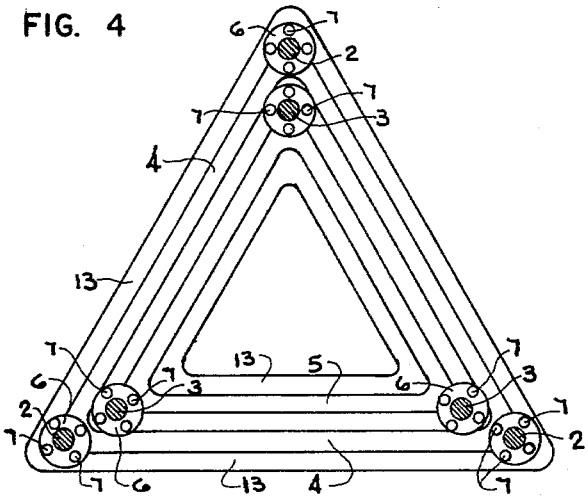

TOWER

BACKGROUND OF THE INVENTION

1. Field of the Invention

This invention relates to a new and improved tower structure, and more particularly, to a new and improved antenna and communications tower structure which is characterized by great strength and rigidity and which may be self-supporting. The tower includes a first set of outside legs arranged in a generally triangular configuration and a corresponding set of inside legs also disposed in a triangular configuration and positioned adjacent the outside legs in coaxial relationship. The inside legs are maintained in rigid alignment with the outside legs of the tower by means of a plurality of horizontally disposed collars positioned in spaced relationship along a substantial portion of the entire height of the tower, and carrying the inside legs and outside legs by means of leg flanges and flange bolts. The improved tower of this invention is characterized by great structural strength and rigidity since it is constructed in the shape of a pair of concentrically and coaxially disposed triangles, and is securely mounted in the earth. Both the outside legs and the inside legs of the tower are braced by means of horizontal braces fastened in spaced relationship to the outside and inside legs, respectively, and both the outside and inside legs are preferably encased in concrete to a selected depth at the base of the tower in order to insure the desired rigidity and strength.

2. Description of the Prior Art

Heretofore, various tower structures exhibiting a wide variety of functions and design choices have been used in the prior art. Typical of the early prior art towers is the structure illustrated in U.S. Pat. No. 296,375 to J. S. and F. U. Adams, which tower is characterized by a steel frame shaped generally in the form of double, offset hexagons, and further including a pair of concentrically disposed triangular shaped frames in the center thereof. Referring to FIG. 5 of the Adams drawing, the cross-sectional configuration of the tower is illustrated and reflects early attempts to achieve structural rigidity through the use of multiple geometric patterns known to have substantial strength.

U.S. Pat. No. 2,116,368 To E. J. Staubitz is characteristic of later tower structures, and discloses an antenna tower having a generally triangular shaped external frame with an inner structure also triangular in shape with the points of the inner triangle coinciding with the centers of the legs of the outer triangle, as illustrated in FIG. 2 of the Staubitz drawing. As further illustrated in the Staubitz drawing, the antenna tower was generally designed to be provided with guys, (reference numerals 10 and 15 in FIG. 1) and is provided with a generally narrow base, as further illustrated in FIG. 3.

Another such tower of later design is illustrated in U.S. Pat. No. 2,945,231 to M. W. Scheldorf, which tower is designed to serve as a communications antenna and is characterized by a generally triangular-shaped cross section having a coaxial inner triangular-shaped cross section, as illustrated in FIG. 3 of the drawing. The inner structure serves as the primary structural member of the antenna while the outer members characterize the suppressor structure. The legs of the tower are designed to be securely anchored in concrete for maximum rigidity and the triangular cross-sectional configuration of the structure insures maximum strength.

An inherent problem in the design of tower structures, and particularly tall tower structures designed to facilitate communication over a large geographical area, is the tendency of such structures to lean, bend and even break under the influence of wind load. Such towers are generally shaped in the form of a triangle in cross-section, since this geometric configuration has proved to be one of the strongest known shapes for tower design. It is apparent that the taller that these towers are built, the greater is the tendency of the tower to bend and ultimately fail under the influence of wind loading. Accordingly, an ideal design for a tower is one which incorporates extreme rigidity and strength from the base to the top in order to provide maximum stability against wind load.

It is therefore an object of this invention to provide a new and improved tower of generally triangular cross-sectional configuration which may be used for communication and other purposes, and which is characterized by great strength and rigidity.

Another object of the invention is to provide a new and improved tower structure, the cross-section of which generally comprises a pair of coaxial triangles with corresponding apexes formed by a set of three outer legs and a set of three inner legs and stabilized by a plurality of collars positioned in spaced relationship along a substantial portion of the length of the tower.

Yet another object of the invention is to provide a new and improved tower structure of great strength and rigidity which is characterized by a first set of three outside legs disposed in a generally triangular configuration and a second set of three inner legs also disposed in generally triangular configuration and corresponding in coaxial, adjacent relationship to the outside legs, respectively, with the legs forming adjacent apexes of the outer and inner triangles, and held securely and rigidly in position by a plurality of collars positioned in spaced relationship along at least a portion of the height of the tower.

A further object of this invention is to provide a self-supporting tower structure characterized by a set of vertically oriented outside legs and a set of vertically oriented inside legs, each of which sets are disposed in a generally triangular configuration and are fitted with several collars and a plurality of braces to impart maximum stability and rigidity to the tower structure.

Yet another object of the invention is to provide a new and improved communications tower formed of a set of three outside legs and a set of three inside legs in the configuration of a pair of concentric and coaxial triangles, each of the legs being braced with the respective adjacent legs of its set and held securely in proper relationship by multiple collars, the legs also being mounted securely in concrete for maximum rigidity.

A still further object of this invention is to provide an improved tower structure which is characterized by a first set of three outside legs disposed in the configuration of an equilateral triangle, and a second set of three inside legs also disposed in the configuration of an equilateral triangle, with each of the legs forming an apex of the respective triangles, and each of the inside legs being disposed adjacent a corresponding one of the outside legs perpendicular to a line bisecting corresponding apexes and corresponding sides of the triangles opposite the apexes, the legs held securely and rigidly in place by collars positioned in spaced relationship along at least a portion of the height of the tower.

SUMMARY OF THE INVENTION

These and other objects of the invention are provided in a tower structure which includes the following elements:

1. A set of three vertically disposed, outside legs shaped generally in the form of a first equilateral triangle, with each leg forming a vertex of the first triangle;
2. A set of three vertically oriented inside legs disposed in essentially parallel relationship to the outside legs and forming a second equilateral triangle inside and coaxial with the triangle formed by the outside legs, with each leg forming a vertex of the second triangle;
3. A plurality of collars, each joined to the outside legs and the inside legs in spaced relationship and distributed along at least a portion of the length of the outside legs and inside legs; and
4. A plurality of generally horizontally disposed braces joining the outside legs and the inside legs, respectively, to add strength and rigidity to the tower structure.

BRIEF DESCRIPTION OF THE DRAWINGS

The invention will be better understood in view of the following description presented with reference to the accompanying drawings:

FIG. 1 of the drawing is a perspective view, partially in section, of a preferred embodiment of the tower of this invention;

FIG. 2 is a front elevation of a top portion of the tower illustrated in FIG. 1;

FIG. 3 is a rear elevation of a top portion of the tower illustrated in FIGS. 1 and 2;

FIG. 4 is a sectional view taken along lines 2—2 in FIG. 2 of the tower illustrated in FIGS. 1-3;

FIG. 5 is a top elevation of a preferred collar for carrying the legs of the tower illustrated in FIGS. 1-3;

FIG. 6 is a sectional perspective view of a portion of the collar illustrated in FIG. 5, more particularly illustrating a preferred technique for joining the legs of the tower together and to the collars; and FIG. 7 is a side elevation, partially in section, of the preferred technique for joining the tower legs to each other and to the collars.

DESCRIPTION OF THE PREFERRED EMBODIMENTS

Referring now to FIGS. 1-3 of the drawing, the tower of this invention is generally illustrated by reference numeral 1, and includes a set of three vertically oriented outside legs 2, disposed in a generally triangular configuration, and a corresponding set of three inside legs 3, also disposed in a generally vertical, triangular configuration and coaxial with and adjacent outside legs 2, respectively. Outside leg braces 4 are joined in horizontal, spaced relationship to outside legs 2, preferably by welding, and in similar manner, inside leg braces 5 are mounted to inside legs 3. In a preferred embodiment of the invention, outside legs 2, inside legs 3, outside leg braces 4 and inside leg braces 5 are formed of solid steel members to insure maximum strength and rigidity ot tower 1, and the braces are welded in sets of three to join the respective legs at selected elevations of tower 1. It is further preferred to provide three outside leg braces 4 at one selected elevation on outside legs 2, and three inside leg braces 5 on inside legs 3 at a different elevation in staggered relationship, as illustrated, in order to impart maximum strength and stiffness to tower 1 along the entire length of the tower.

Referring now particularly to FIG. 1 and FIGS. 5-7 of the drawing, it will be appreciated that in a preferred embodiment of the invention, the respective sections of outside legs 2 and inside legs 3 are formed of round steel stock of selected length for assembly, and are provided with leg flanges 6, which are welded to the ends of the leg sections in order to provide a means for bolting the sections together and constructing tower 1. Furthermore, as illustrated in FIGS. 5 and 6 of the drawing, outside legs 2 and inside legs 3 are maintained in proper parallel orientation with respect to each other by means of a plurality of collars 13 which are positioned in spaced relationship along a substantial portion of the length of tower 1. Collars 13 are each provided with collar outside leg apertures 14 and collar inside leg apertures 15 to receive outside legs 2 and inside legs 3, respectively, in the assembly operation, as hereinafter more particularly described. Referring again to FIG. 6, leg flanges 6 are each provided with flange bolt apertures 8 and are securely welded to the ends of outside legs 2 and inside legs 3, by a weld 12, with a leg projection 17 extending beyond the end of each of leg flanges 6 in a preferred aspect of the invention. Leg projection 17 is designed to seat in collar outside leg apertures 14 and collar inside leg apertures 15 of collar 13, as illustrated in FIGS. 5 and 6 of the drawing in order to facilitate alignment of the respective tower sections prior to the bolting operation. Collar bolt apertures 16 are also provided in collar 13 for registration with flange bolt apertures 8 in leg flanges 6 to permit insertion of flange bolts 7 through leg flanges 6 and collar 13, and securing of flange bolts 7 by means of flange washers 9 and flange nuts 10 on flange bolt threads 11.

Referring again to FIGS. 1-3 and FIG. 5 of the drawing, each collar 13 is preferably formed with a collar opening 25 to facilitate easy access through the center of the tower and to reduce weight. However, the top of tower 1 is characterized by a cap collar 19 which is shaped in the form of collar 13 but is solid in cross-sectional area. To the top of cap collar 19 is mounted an optional mast 20 with mast collar 21 and mast braces 22, which mast 20 may be formed in the shape of any suitable antenna or radio or television transmission means, according to the knowledge of those skilled in the art. Appropriate transmission and receiving equipment can be mounted on the top of tower 1 and/or at any elevation thereof according to the particular requirements for any given installation and the knowledge of those skilled in the art.

Referring now to FIG. 4 of the drawing, it will be appreciated that the stabilizing of outside legs 2 and inside legs 3 in concentric and coaxial triangular configurations by means of multiple collars 13, outside leg braces 4 and inside leg braces 5 enables the construction of a rigid tower structure of surprising strength, rigidity and resistance to wind load. Furthermore, when outside legs 2 and inside legs 3 are securely mounted in a tower base 18 as illustrated in FIG. 1 of the drawing, which base is typically characterized by a block of concrete of sufficient thickness and depth to support a tower of desired height, the resulting structure is rigid from base to top with minimum flexure under load. The tower of this invention is designed to be generally self-supporting due to the strength and rigidity of the coaxial triangular structure described above. However, referring again to FIGS. 1–3 of the drawing, it will be appreciated that in the event a tower of extreme height is desired to be constructed, for example from the 1500–3000 foot height, guy mounts 23 and guys 24 can be used to help stabilize the structure as deemed necessary by those skilled in the art.

It will be appreciated that the tower of this invention may be easily constructed in sections, with the bottom or base section initially securely anchored to a suitable tower base 18. The upwardly projecting leg segments forming the base section and a set of outside legs 2 and inside legs 3 formed in a second tower section of selected length are then fitted with leg flanges 6, preferably by the expedient of welding, as illustrated in FIG. 6 of the drawing. A common collar 13 is then welded to each of the leg flanges 6 corresponding to the tower section to be raised, with the flange bolt apertures 8 of the leg flanges 6 in registration with collar bolt apertures 16 of the collar 13. This tower section is then lifted by a crane into registration with the upwardly extending outside legs 2 and inside legs 3 of the base or bottom segment of the tower, and the two sections are secured by means of flange bolts 7, flange washers 9 and flange nuts 10, as heretofore described. After the bolting operation is completed, the bottom ones of leg flanges 6 may be welded to the collar 13, if desired, for additional security. A third tower section which has been shaped as described above and as illustrated in FIGS. 1–3 is then constructed on the ground in the same manner as the second section, and leg flanges 6 are again welded to each one of outside legs 2 and inside legs 3. The entire section is then lifted in place and the newly constructed section is matched with the second section of the tower. In the case of each succeeding section which is fabricated and bolted in place, each leg projection 17 of outside legs 2 and inside legs 3 matches each respective one of collar outside leg apertures 14 and collar inside leg apertures 15, respectively, to facilitate alignment of flange bolt apertures 8 and collar bolt apertures 16 and permit insertion of flange bolt 7 and bolting of the sections together.

It will be appreciated that while it is preferred in each section attachment to weld the bottom leg flanges 6 to each respective collar 13 after flange bolts 7 have been secured to leg flanges 6, it will not always be possible to do so as successive sections of the tower are bolted in place, since under normal circumstances the welding equipment may not be accessible to the higher sections of the tower. Accordingly, in the upper sections of the tower it is preferred merely to secure a strong weld 12 between outside legs 2 and inside legs 3 and leg flanges 6, respectively, in each successive section, and to depend upon flange bolts 7 to secure the respective sections of the tower together. However, while it is preferred for ease of construction and maintenance to bolt the respective tower sections together, it will be understood that the tower can be entirely constructed by riveting or welding, if desired, by techniques and equipment known to those skilled in the art. Furthermore, all surfaces exposed to weather are preferably galvanized or painted in order to minimize corrosion. It will be understood by those skilled in the art that the tower of this invention is sufficiently strong and rigid to be self-supporting even at some of the higher heights to which it may be constructed. Accordingly, the double and coaxial triangular tower structure constructed in the manner described above provides a built in safety factor even under circumstances where it is desired to guy the tower for added safety at the higher elevations. While it is preferred to construct the outside legs and inside legs of solid metal members of a selected size, it will be appreciated that the inside legs may be constructed of a larger or smaller member than the outside legs, as dictated by design requirements. Furthermore, while round, solid steel members are preferred as a material of construction, other shapes and/or metals can be utilized according to the knowledge of those skilled in the art. Referring again to FIGS. 1–3 of the drawing, when tower 1 is braced by use of guys 24 and guy mounts 23, in the unlikely event that a guy should break, the tower can be quickly and easily repaired without danger of collapse. Furthermore, the tower can be mounted and maintained by painting, replacing various parts, and the like, without subjecting the workmen to the danger of collapse due to the added weight on the tower structure.

Yet another advantage of the tower of this invention lies in the fact that it can be easily constructed section by section and each section can be quickly and easily fitted to the preceding section by expedient alignment of the leg flanges and legs by means of a crane or other lifting device in the manner described above. Also, while the effective height of the tower is substantially limited only by practical considerations such as transmitting altitude considerations, it will be appreciated that the tower may be easily built to heights of up to 3,000 feet.

Having described my invention with the particularity set forth above, what is claimed is:

1. A tower comprising:

(a) a set of three vertically disposed outside legs positioned generally in the shape of a first triangle;

(b) a set of three vertically disposed inside legs spaced from said outside legs and positioned generally in the shape of a second triangle and oriented inside said first triangle;

(c) a plurality of generally horizontally disposed collars shaped generally in the form of a triangle and having spaced apertures for carrying said outside legs and said inside legs in spaced relationship near the apexes of said triangle at selected points along the length of said tower; and (d) leg flanges provided on said outside legs and said inside legs on each side of said collars, respectively, to join sections of said outside legs and said inside legs, respectively, with the ends of said outside legs and said inside legs projecting beyond said leg flanges for registration with said spaced apertures in said collars.

2. The tower of claim 1 further comprising a first plurality of braces joining said outside legs and a second plurality of braces joining said inside legs at preselected intervals along the length of said tower.

3. The tower of claim 1 wherein a bottom portion of said outside legs and said inside legs are embedded in concrete.

4. The tower of claim 1 further comprising a first plurality of braces joining said outside legs and a second plurality of braces joining said inside legs at preselected intervals along the length of said tower, and wherein a bottom portion of said outside legs and said inside legs are embedded in concrete.

5. The tower of claim 1 further comprising a plurality of guys, each having one end secured to said tower and the other end secured to the ground.

6. The tower of claim 1 wherein a bottom portion of said outside legs and said inside legs are embedded in concrete and further comprising:

(a) a first plurality of horizontally disposed braces joining said outside legs and a second plurality of horizontally disposed braces joining said inside legs in staggered relationship to said first plurality of braces, said braces located at preselected intervals along the length of said tower; and (b) a plurality of guys, each having one end secured to said tower and the other end secured to the ground.

* * * * *